US006796300B2

(12) United States Patent
Petrosyan et al.

(10) Patent No.: US 6,796,300 B2
(45) Date of Patent: Sep. 28, 2004

(54) MAGAZINE FOR BULLET-SHOOTING PNEUMATIC FIREARM

(75) Inventors: Aleksei Lvovich Petrosyan, Moscow (RU); Aleksei Borisovich Shipachev, Kazan (RU)

(73) Assignee: Zakrytoe aktsionernoe obshchestvo Gruop "ANICS" , Moscow (RU)

( * ) Notice: Subject to any disclaimer, the term of this patent is extended or adjusted under 35 U.S.C. 154(b) by 0 days.

(21) Appl. No.: 10/687,841

(22) Filed: Oct. 20, 2003

(65) Prior Publication Data

US 2004/0149276 A1 Aug. 5, 2004

Related U.S. Application Data

(62) Division of application No. 10/181,933, filed as application No. PCT/RU01/00497 on Nov. 21, 2001.

(51) Int. Cl.[7] ..... F41A 9/61
(52) U.S. Cl. ..... 124/48; 89/33.1; 42/49.01
(58) Field of Search ..... 89/33.1; 124/45, 124/48, 49, 51.1; 42/49.01, 49.1

(56) References Cited

U.S. PATENT DOCUMENTS

| | | | | |
|---|---|---|---|---|
| 2,086,339 A | * | 7/1937 | Sosso | 42/49.01 |
| 2,569,995 A | | 10/1951 | Kapsa | |
| 3,077,875 A | | 2/1963 | Kline et al. | |
| 3,447,527 A | | 6/1969 | Cermak et al. | |
| 4,147,152 A | | 4/1979 | Fischer et al. | |
| 4,986,251 A | * | 1/1991 | Lilley | 124/67 |
| 4,993,400 A | * | 2/1991 | Fitzwater | 124/48 |
| 5,845,629 A | * | 12/1998 | Ratliff | 124/56 |
| 6,439,216 B1 | * | 8/2002 | Johnson et al. | 124/70 |
| 2001/0027786 A1 | * | 10/2001 | Kunimoto | 124/73 |

FOREIGN PATENT DOCUMENTS

| | | | | |
|---|---|---|---|---|
| DE | 196 35 657 | | 3/1998 | |
| EP | 0 844 456 | | 5/1998 | |
| FR | 2 779 813 | | 12/1999 | |
| GB | 1 375 774 | | 11/1974 | |
| GB | 2244121 A | * | 11/1991 | F41B/11/02 |
| RU | 2094734 | | 10/1997 | |
| RU | 2118781 | | 11/1997 | |
| WO | 99/64809 | | 12/1999 | |

* cited by examiner

*Primary Examiner*—Michael J. Carone
*Assistant Examiner*—Troy Chambers
(74) *Attorney, Agent, or Firm*—Jacobson Holman PLLC

(57) ABSTRACT

A magazine for a bullet-shooting pneumatic firearm comprises a casing 1. Inside the casing 1 a closed passage 2 is provided, equipped with containers 3 with bullets 5. The magazine has a bullet opening 11 in a wall 9 of the casing 1, through which the bullet 5 during the shot, under the action of a portion of gas, gets from the container 3 into a bullet passage 12 of a barrel 10 of the firearm. The opening 11 is disposed coaxially with the bullet passage 12 of the barrel 10 of the firearm and with a through opening 4 of the container 3occupying such position before each shot. In the wall 9 of the casing 1 above the closed passage 2 above the through opening 4 of the containers 3 a port 14 is provided for receiving an external arm 15 of a striker-and-trigger mechanism 16, under the action of which the containers 3 move along the closed passage 2, each container 3 being positioned sequentially to the shooting line. In a side wall 25 of the body 1 a longitudinal opening 26 is provided for the containers to be moved with the shooter's finger when the containers are loaded with bullets 5. 14 claims, 17 illustrations.

3 Claims, 4 Drawing Sheets

MAGAZINE FOR BULLET-SHOOTING PNEUMATIC FIREARM

This is a divisional of application Ser. No. 10/181,933 filed Oct. 24, 2002, which is a nationalization of PCT/RU01/00497 filed Nov. 21, 2001 and published in Russian.

FIELD OF THE INVENTION

The present invention relates to compressed gas operated firearms and more particularly to multiple-charge magazines for pneumatic gas-cylinder operated firearms shooting bullets, and also to containers for bullets, used in magazines of such firearms.

STATE OF THE ART

Known in the art are designs of magazines employed in pneumatic firearms using compressed gas cylinders and shooting, for instance, spherical bullets.

Bin-type magazines are known (U.S. Pat. No. 3077875, Cl. 124-76, 1963 and U.S. Pat. No. 4147152, Cl. F41B 11/06, priority of Mar. 1, 1977), wherein bullets are loaded into a cavity present in the pistol itself, and the bullets are passed for shooting into the barrel by gravity. Though the capacity of the magazine is large, the absence of forced feeding the bullets from the bin into the barrel makes the reliability of such a firearm low and limits the possibility of shooting from such a firearm, for instance, when its barrel is directed downwards.

Magazines are known, which are an independent structure (U.S. Pat. No. 3,447,527, Cl. 124-52, 1969) comprising a casing inside which bullets are arranged in one row. Under the action of a spring and a follower located in the lower portion of the casing, bullets are delivered to the shooting line. The magazine may be located directly in the pistol grip (U.S. Pat. No. 2,569,995, Cl. 124-53, 1951). In these magazine structures forced bullet feed to the firearm barrel is employed. Disadvantages of such magazines are their small capacity, as well as low reliability because of possible dropout of the bullets from the magazine as the latter is installed into or withdrawn from the firearm.

A structure is known in the art (Application EP 0844456 A2, Cl. F41B Nov. 2, 1998), wherein directly in the pistol under the barrel a passage is provided for locating bullets therein, the bullets being delivered to the shooting line under the action of a spring and a follower. This structure is disadvantageous in a limited capacity of the magazine and long process of magazine reloading.

A magazine is known (Patent RU 2118781, Cl. F41B Nov. 6, 1998), which is disposed in the pistol grip, wherein bullets are located in a bulk casing in which a spring with a follower are arranged, which provide sequential delivery of each bullet to the shooting line. This structure is disadvantageous in a limited capacity of the magazine.

The nearest analog is the structure of a magazine (Application PCT/FR 99/01199) located in the pistol grip. Bullets are disposed in a casing in a semioval passage, wherein a spring with a follower are arranged which provide sequential feeding of bullets into the barrel for shooting. An advantage of such a magazine is fast loading of the magazine and convenience of magazine removal from the firearm. The main disadvantage of this structure is inadequate reliability of feeding bullets into the barrel of the firearm.

Besides, all the above magazine structures suffer from common disadvantages:

only spherical bullets can be used in these magazines;

bullets in these magazines are subject to deformations associated with the mechanical mutual interaction of the bullets and with the direct action thereon of parts of the magazine and firearm, whereby the ballistic characteristics of the bullets and of the firearm are impaired.

ESSENCE OF THE INVENTION

The herein-proposed technical solutions are based on the idea of providing a magazine for a pneumatic firearm shooting bullets of an arbitrary form, which magazine will be structurally simple, easy to manufacture, convenient in service, in which magazine bullets are preliminarily loaded into containers, and these containers are arranged in a closed passage and move therealong, each loaded container being sequentially delivered to the shooting line for shooting.

The use of such magazine structure makes it possible to:

improve the reliability of feeding bullets for shooting, and thus to inprove the reliability of the firearm itself;

increase the magazine capacity owing to the presence of a closed passage practically of an arbitrary form and length;

provide efficient and convenient magazine replacement or reloading.

The use of containers for bullets in the magazine additionally makes it possible to:

use bullets of practically arbitrary form for shooting;

eliminate deformation of bullets in the magazine, whereby ballistic characteristics of the firearm are improved.

This is achieved by that a magazine for a pneumatic bullet-shooting firearm, comprising a casing with a port for loading the magazine with bullets, is provided with containers having a through opening, in each of which one bullet is accommodated. The containers are installed in a closed passage, along which they move inside the casing with the possibility of feeding sequentially one loaded container after another to the shooting line for shooting, with a simultaneous removal of an empty container from the shooting line after the shot. The magazine has a bullet opening in a wall of the casing, through which a bullet during the shot under the effect of a portion of a gas gets from the container into a bullet passage of the firearm barrel, a port for the entrance of a portion of gas for a shot to occur, which is disposed in a wall of the casing opposite to the bullet opening and coaxially with the through passage of the firearm barrel and with the through opening of a container with a bullet, said container occupying such position before each shot, and a port disposed in the wall of the casing above a closed passage above the through opening of the containers for an external arm of a striker-and-trigger mechanism, under the action of which the containers move along the closed passage with a successive positioning of each container on the shooting line.

The cross-section of the closed passage repeats the form of the generatrix of the container exterior, and the length of the passage is such that the clearance between two containers standing side by side provides their free movement along the passage.

Installed in the magazine casing between an upper wall of the casing and the closed passage is a block which contacts the containers and provides stable sequential positioning of each loaded container coaxially with the bullet passage of the firearm barrel before the shot. The wall of the block viewed from the side of the closed passage has a form repeating the form of the external wall of the passage, when the containers move along the passage. In the block wall from the side of the closed passage a cutout is provided, whose form repeats the form of the generatrix of the external side wall of the container. Between the wall of the casing and the block at least one spring is installed, which urges the block away from the wall of the casing in such a manner that during each movement of the containers along the closed passage the lower side of the block becomes a natural continuation of the side wall of the passage, and as the next in turn loaded container is brought to the shooting line the block descends onto the container for fixing the position of the container before the shot.

The port for loading the magazine with bullets is disposed in the wall of the casing above the closed passage above the through opening in the containers. The width of the port for loading the magazine with bullets is smaller than the external cross-section of the container, but larger than the cross-section of the bullet.

In the side wall of the magazine a longitudinal opening is provided, whose width is smaller than the longitudinal section of the container, serving for the containers to move under the effect of the shooter's finger in loading the container with bullets.

The container is provided with a leaf spring which may be installed:

either on the wall of the casing above the port for supplying a portion of gas to the container, when the magazine is disposed in the firearm with a movable barrel, the leaf spring having an opening for a portion of gas to enter the container, the diameter of the opening being smaller than the cross-section of the bullet;

or on the wall of the casing above the bullet opening, when the magazine is disposed in the firearm with a stationary barrel, the leaf spring having an opening for the bullet to be delivered from the container into the firearm barrel during the shot, the diameter of the opening being larger than the cross-section of the bullet.

The magazine is further provided with a second opening in the wall of the casing above the closed passage above the through opening of the containers, adapted to receive a second external arm of the striker-and-trigger mechanism, under the action of which an empty container is withdrawn from the shooting line after the shot.

The container for bullets of a pneumatic firearm magazine, comprising a casing, has a barrel portion disposed from the side of a barrel, when the container is arranged in the magazine, and a valve portion disposed from the side of gas portion supply, end sides, a through opening between the barrel and valve sides, longitudinal projections being provided inside the opening on its wall, said projections being located nearer to the barrel end side, and tail projections located nearer to the valve side, for retaining the bullet inside the container after loading the latter. The longitudinal projections are located at a certain distance from the barrel end side of the container, and the tail projections are located at a certain distance from the valve end side of the container. The containers may have an arbitrary form, e.g., cylindrical or barrel-shaped. Bullets used for loading the container may have arbitrary form, e.g., spherical, cylindrical or spindle-shaped and may be made from iron or have an iron core, or be manufactured from a softer metal or plastic.

BEST WAY OF CARRYING OUT THE INVENTION

Figure 2:
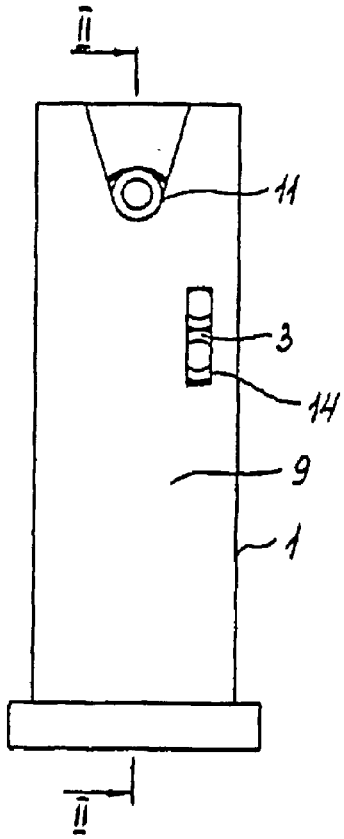
FIG. 2 is a front view of a magazine.
Figure 3:
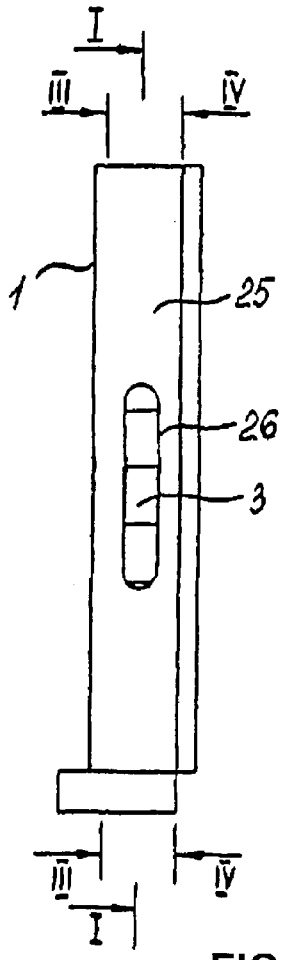
FIG. 3 is a side view of a magazine.
Figure 4:
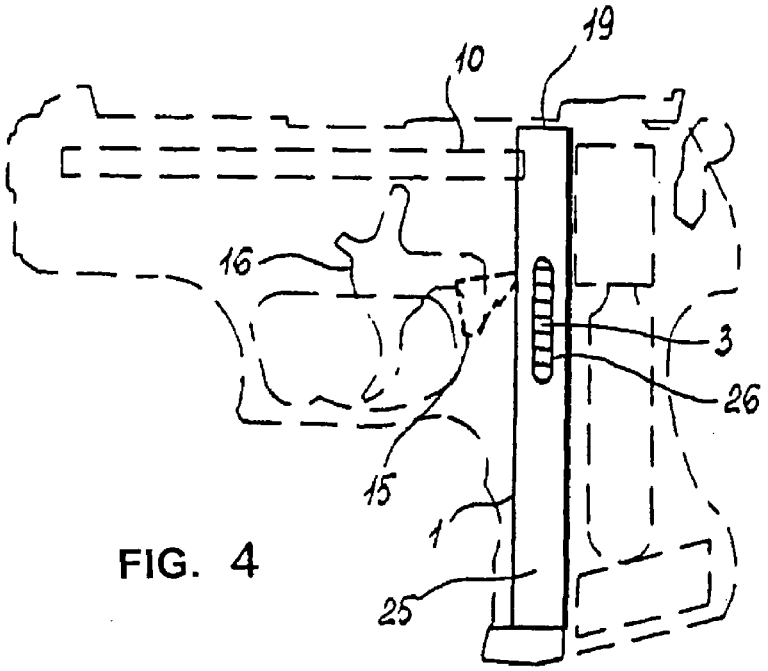
FIG. 4 is a variant of locating a magazine in a firearm grip.
Figure 5:
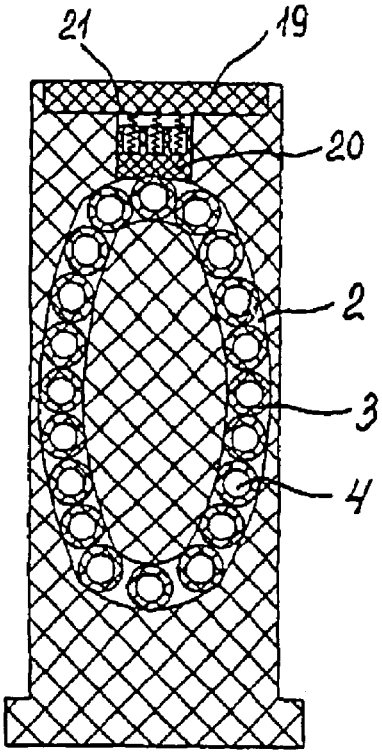
FIG. 5 is a sectional view taken along line I—I in FIG. 3, when a loaded container is disposed on the shooting line before a shot.
Figure 6:
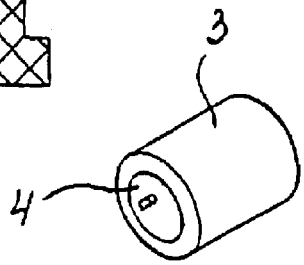
FIG. 6 is a general view of a container.

A magazine (FIGS. 1–3) for a bullet-shooting pneumatic firearm, to be disposed, for instance, in a firearm grip (FIG. 4), comprises a casing 1. A closed passage 2 is disposed in the casing 1 (FIG. 5). Containers 3 are arranged in the passage 2 one after another in a chain-like manner (FIG. 6), each container having a through opening 4 for loading the container with a bullet 5.

Figure 7:
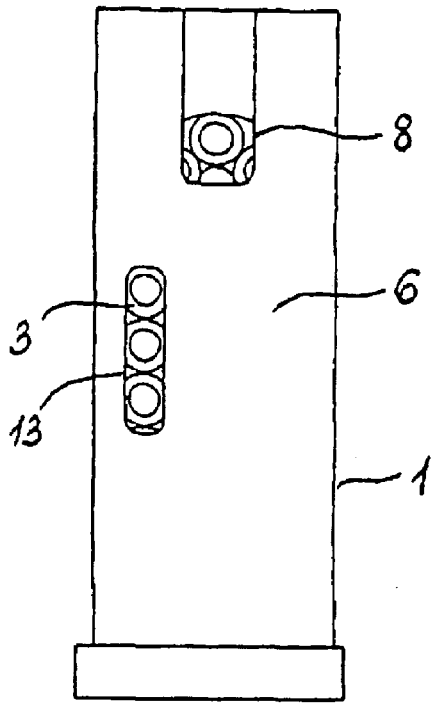
FIG. 7 is a rear view of a container.

In a wall 6 of the casing 1, as viewed from the side of a passage 7 from which a portion of gas comes into the container 3 at the moment of a shot, there is a port 8 (FIG. 7). In a wall 9 of the casing 1, which is opposite the port 8, as viewed from the side of a firearm barrel 10, there is a bullet opening 11 through which under the pressure of a portion of gas a bullet 5 during the shot gets from the container 3 into a bullet passage 12 of the firearm 10. The port 8 and the opening 11 are disposed coaxially with the through opening 4 of the container 3, when a next container 3 loaded with bullet 5 occupies a position on the shooting line directly before a shot.

The wall 6 of the casing 1 is also provided with a port 13 for loading containers 3 with bullets 5. Such port 13 is disposed at least above one of the containers 3. The width of the port 13 is selected to be larger than the cross-section of the bullet 5 but smaller than the cross-section of the end side of the container 3, adjoining the casing 1 from the side of the port 13.

Figure 8:
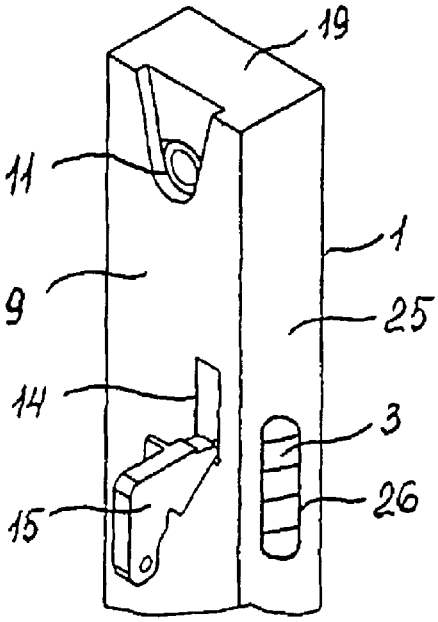
FIG. 8 is a general view of a magazine with one arm of a striker-and-trigger mechanism.

Disposed in the wall 9 above the closed passage 2 from the side of the openings 4 of the containers 3 is a port 14 (FIG. 8), intended to receive an external arm 15 connected with a striker-and-trigger mechanism 16 of the firearm. Under the action of the arm 15, for instance, when the terminal portion of the arm 15 enters the movable container 3, the containers become moved along the closed passage 2, and each container 3 loaded with the bullet 5 is delivered sequentially to the shooting line.

Figure 9:
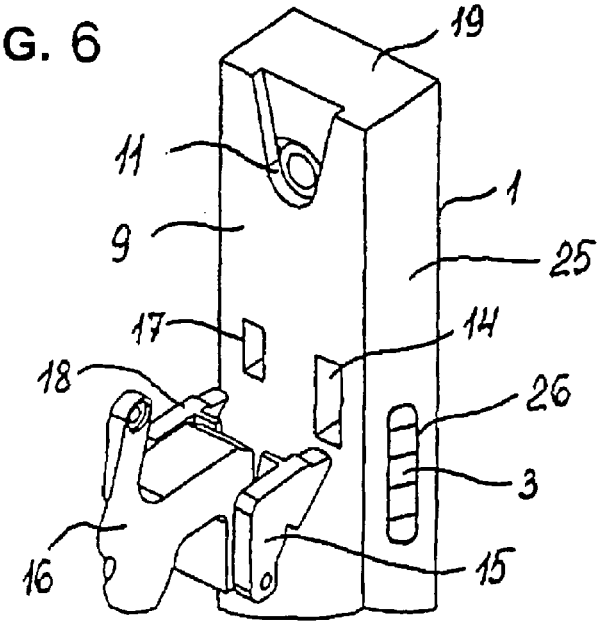
FIG. 9 is a general view of a magazine with two arms of a striker-and-trigger mechanism.

For a more reliable movement of the containers 3 along the closed passage 2, a second port 17 (FIG. 9) may be provided, e.g., in the wall 9, this second port being intended for receiving an external arm 18 connected with the striker-and-trigger mechanism 16 of the firearm. Under the action of the second arm 18 the containers 3 move along the closed passage 2 in the same direction, with each empty container 3 being withdrawn from the shooting line after a shot. Owing to an additional effort of the arm 18, a certain jamming of the containers 3 as they move along the passage 2 is eliminated.

Figure 10:
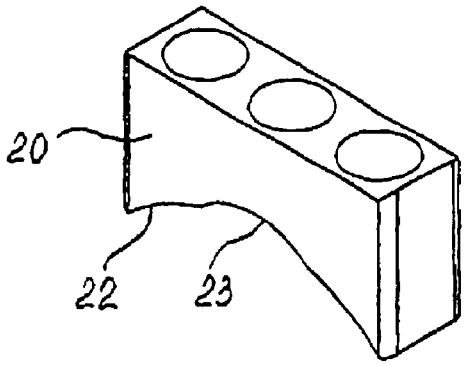
FIG. 10 is a general view of a block.

For a more exact coaxial registration of each loaded container 3, delivered to the shooting line for a next shooting, with the bullet passage 12 of the barrel 10, a block 20 (FIG. 10) is installed inside the casing 1 of the magazine between its upper wall 19 and the closed passage 2. Between the wall 19 of the casing and the block 20 at least one spring 21 is disposed in such a manner that the block 20 enters the passage 2 for a certain distance, when the successive loaded container 3 is positioned on the shooting line directly before a shot (FIG. 5). A lower wall 22 of the block 20, which has a concave form repeating the form of the external generatrix of, the passage 2 is, as it were, a natural component part of this passage 2, when the containers 3 under the action of the arms 15 and 18 move along the passage 2. A portion of the lower wall 22 of the block 20 has a cutout 23, whose form repeats the form of the generatrix of an external side wall 24 of the container 3. The block 20 is in constant contact with the containers 3 and provides stable position of each loaded container 3 on the shooting line before the shot.

Figure 1:
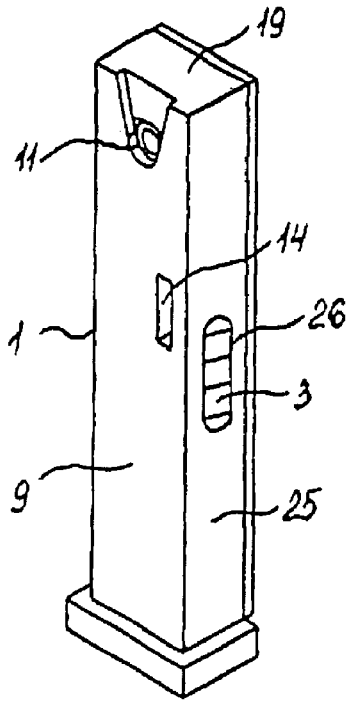
FIG. 1 is a general view of a magazine.

For convenience of loading the magazine with bullets 5, in a side wall 25 of the casing 1 a longitudinal opening 26 is provided, whose width is smaller than the longitudinal section of the container 3 (FIG. 1).

Figure 12:
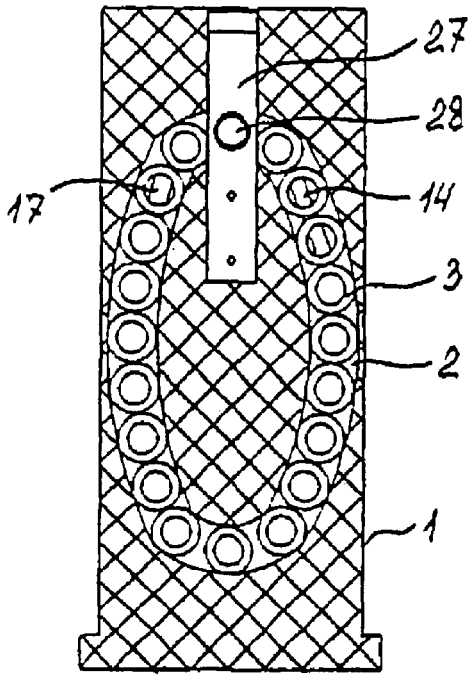
FIG. 12 is a sectional view taken along line III—III in FIG. 3, when a magazine is used in a firearm having a movable barrel.
Figure 11:
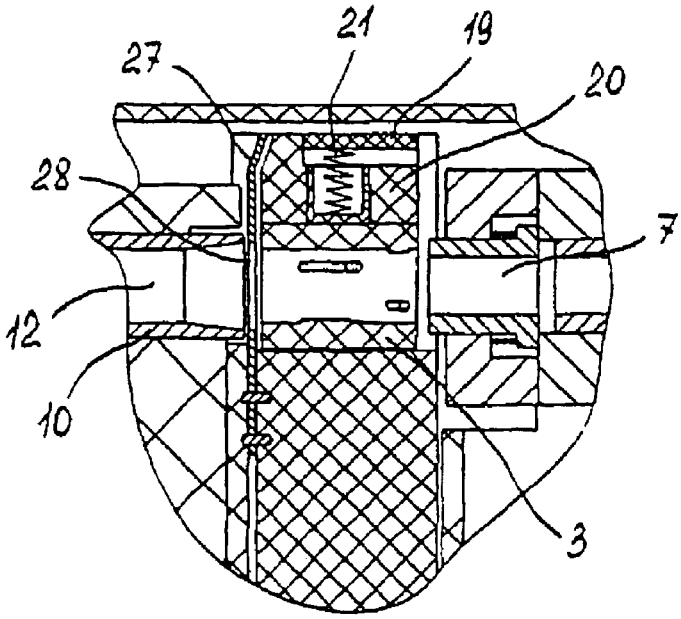
FIG. 11 is a sectional view taken along line II—II in FIG. 2, when a magazine is installed in a firearm having a movable barrel.
Figure 13:
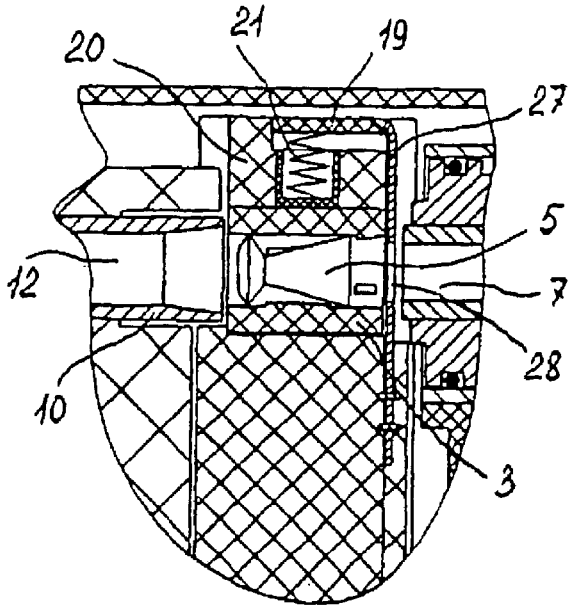
FIG. 13 is a sectional view taken along line II—II in FIG. 2, when a magazine is installed in a firearm having a stationary barrel.
Figure 14:
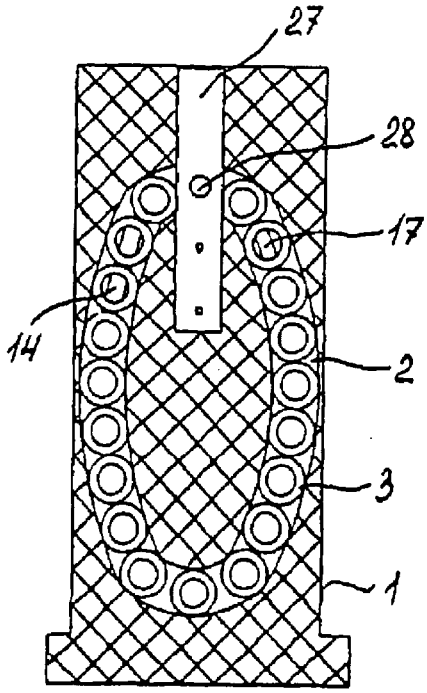
FIG. 14 is a sectional view taken along line IV—IV in FIG. 3, when a magazine is used in a firearm having a stationary barrel.

The magazine is further provided with a leaf spring 27 which is a flat plate with an opening 28. Depending on the design of the firearm in which the proposed magazine is used, the leaf spring may be installed in one of two places. In the firearm with a movable barrel the leaf spring is installed on the wall of the wall 6 of the casing 1 above the port 8 for supplying a portion of gas to the container 3, behind the container 3 in such a manner that the opening 28 is disposed coaxially with the through opening 4 of the loaded container 3 positioned on the shooting line, and with the bullet passage 12 of the barrel 10 (FIGS. 11, 12). In the firearm with a stationary barrel the leaf spring 27 is installed on the wall 9 of the casing 1 from the side of the barrel 10, in front of the container 3 in such a manner that the opening 28 is disposed coaxially with the through opening 4 of the loaded container 3 positioned on the shooting line, and with the bullet passage 12 of the barrel 10 (FIGS. 13, 14).

To eliminate jamming of the containers 3 during their movement along the closed passage 2, the cross-section of the passage 2 repeats the form of the generatrix of the external portion of the containers 3. The length of the passage 2 is selected such that the clearance between two containers 3 standing side by side provides their free movement along the passage 2.

Loading of the magazine proceeds as follows. Containers 3 are preliminarily installed in the passage 2 inside the casing 1 of the magazine. Through the port 13 in the wall of the casing 1 bullet 5 is loaded into each container 3. After all the containers 3 standing against the port 13 have been loaded, the shooter moves with his finger through the opening 26 in the side wall 25 of the casing 1 all the containers 3 along the passage 2 till a next group of empty containers 3 is installed opposite the port 13 for loading. After loading all the containers, 3 the magazine is ready for installing into the firearm. Reloading of the magazine proceeds similarly.

Figure 15:
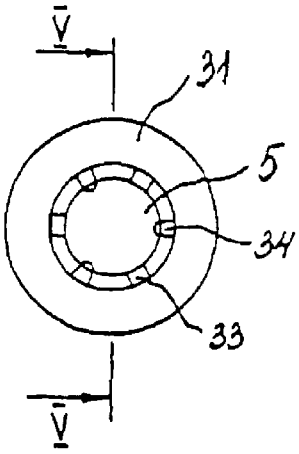
FIG. 15 is an end elevation view of a container with a bullet.
Figure 16:
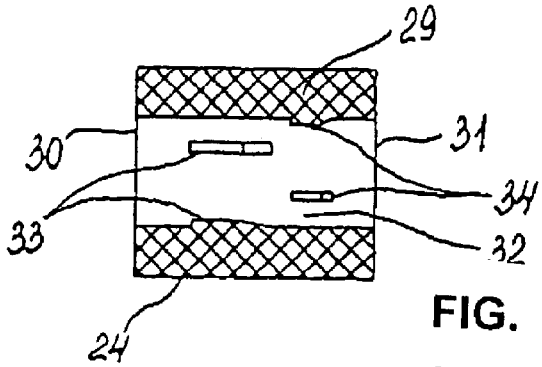
FIG. 16 is a sectional view taken along line V—V in FIG. 15, when a cylinder-shaped container is not loaded.
Figure 17:
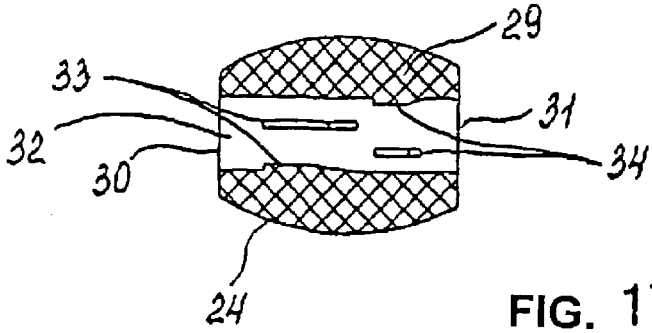
FIG. 17 is a sectional view taken along line V—V in FIG. 15, when a barrel-shaped container is not loaded.

The container 3 (FIGS. 6, 15) for the bullets 5 of the pneumatic firearm comprises a casing 29. In the casing 29 between its barrel end side 30 as viewed from the side of the firearm barrel 10, when the container is located in the magazine, and valve end side 31 as viewed from the side of supplying a portion of gas, through opening 4 is provided. Inside the opening 4 on its wall 32 there are provided longitudinal projections 33 (FIGS. 16, 17), located nearer to the barrel side 30, and tail projections 34 located nearer to the valve side 31, said projections retaining the bullet 5 inside the container 3 after loading thereof. The longitudinal projections 33 and the tail projections 34 are located at a certain distance from the barrel end side and the valve end side, respectively, so that the terminal portion of the arms 15 and 18, entering the container 3, could not reach the bullet 5 found in the container 3.

The form of the generatrix of the external side of the container 3 repeats the form of the closed passage 2 along which along which bullets move along the passage 2 of the magazine. Therefore the containers 3 may have, for instance, a cylindrical, barrel-like, or other form. The bullets 5 used for loading into the container 3 may be cylindrical, spindle-shaped or have any other arbitrary form. With the use of containers 3 for bullets 5 in the magazine, any deformation of the bullets because of the mechanical mutual interaction of the bullets or of the parts of the firearm is ruled out. Therefore bullets used in the firearm using magazines with bullet containers may be not only made from iron, but also from a softer metal or plastic, may be provided with an iron core or have no such core.

INDUSTRIAL APPLICABILITY

The invention can easily be embodied, using contemporary materials, on the basis of present-day technology, and may be used most effectively in repeating bullet-shooting pneumatic firearms.

What is claimed is:

1. A container for bullets of a pneumatic firearm magazine, comprising a casing, characterized in that the container has a barrel portion disposed from the side of a barrel, when the container is arranged in the magazine, and a valve portion disposed from the side of gas portion supply, end sides, a through opening between the barrel and valve sides, longitudinal projections being provided inside the opening on its wall, said projections being located nearer to the barrel end side, and tail projections located nearer to the valve side, for retaining the bullet inside the container after loading thereof.

2. A container according to claim 1, characterized in that the longitudinal projections are located at a distance from the barrel end side of the container.

3. A container according to claim 1, characterized in that the tail projections are located at a distance from the valve end side of the container.

* * * * *